United States Patent [19]

Kupperman et al.

[11] 4,156,986

[45] Jun. 5, 1979

[54] ONE-PIECE MOLDED PLASTIC VEHICLE AND TRANSPORT MEMBER

[75] Inventors: Sam Kupperman, Chicago; Dennis Kupperman, Glenview, both of Ill.

[73] Assignee: RB Toy Development Co., Skokie, Ill.

[21] Appl. No.: 811,785

[22] Filed: Jun. 30, 1977

[51] Int. Cl.[2] ..... A63H 29/20

[52] U.S. Cl. ..... 46/201; 46/209

[58] Field of Search ..... 46/17, 95, 201, 209

[56] References Cited

U.S. PATENT DOCUMENTS

| | | | |
|---|---|---|---|
| 2,777,248 | 1/1957 | Hirsch et al. | 46/95 |
| 3,634,965 | 1/1972 | McAuley | 46/17 |
| 3,984,939 | 10/1976 | Wolgamot et al. | 46/209 |

FOREIGN PATENT DOCUMENTS

| | | | |
|---|---|---|---|
| 1074467 | 1/1960 | Fed. Rep. of Germany | 46/209 |

*Primary Examiner*—Louis G. Mancene
*Assistant Examiner*—Robert F. Cutting
*Attorney, Agent, or Firm*—Vogel, Dithmar, Stotland, Stratman & Levy

[57] ABSTRACT

A one-piece toy vehicle comprising a body having opposing side walls, a circular transport member integrally molded therewith and separable therefrom, the transport member having an axle extending outwardly therefrom with journals at the distal ends thereof, means for supporting the axle journals with respect to the side walls to permit free rotation of the circular transport member with respect to the body with the rim of the circular transport member extending beyond the lower boundary body to provide a rolling surface for the toy vehicle. Means are provided in the transport member for accommodating a ballast such that the weight ratio of the transport member and ballast to the toy vehicle is about 1.

12 Claims, 6 Drawing Figures

ONE-PIECE MOLDED PLASTIC VEHICLE AND TRANSPORT MEMBER

BACKGROUND OF THE INVENTION

Toy vehicles for children are so numerous that it would be impossible to discuss each and every design available. However, most of the vehicles that are relatively large, currently are made from plastic materials while most of the vehicles that are relatively small are made from metal or other heavy materials. This invention is restricted to non-powered, light weight or plastic vehicles.

Heretofore, light weight plastic vehicles have not been commercially available which are small in size and also non-powered. The reason for this is that the light weight nature of the plastic renders them unsuitable for play, since they cannot be pushed by the child for any length or distance due to the inability to remain upright if given a "hard shove". Small cars or toy vehicles made out of metal or the like involve more difficult molding problems and are more expensive, whereby these vehicles are outside the scope of the present invention. Accordingly, a small, plastic, non-powered vehicle has been needed in the toy field, and particularly, one which will travel for relatively long distances powered only by a manual push. It is to fill this need in the art that the present invention is directed. The present invention is particularly adaptable for use in the premium field due to the novel, one-piece design or construction. The easy assembly is also an important feature since the toy is directed to a rather youthful audience.

SUMMARY OF THE INVENTION

This invention is directed to a one-piece molded construction of a plastic material which easily may be assembled into a toy vehicle of a size to be included in a box of cereal or the like.

It is a principal object of the present invention to provide a one-piece construction including a vehicle and transport member therefor and the assembled toy vehicle produced therefrom.

An important object of the present invention is to provide a toy vehicle comprising a one-piece body having opposing side walls, a circular transport member having an axle extending outwardly therefrom with the journals at the distal end thereof, means for supporting the axle and journals with respect to the side walls to permit free rotation of the circular transport member with respect to the body, the rim of the circular transport member extending beyond the lower boundary of the body to provide a rolling surface for the vehicle.

Another object of the present invention is to provide a one-piece construction of synthetic organic resin comprising a hollow body portion having opposing side walls, a circular transport member having an axle extending outwardly therefrom with journals on the distal ends thereof, tab means interconnecting the hollow body and the circular transport member having a reduced width, length, and thickness to facilitate separation of the transport member from the body, means for supporting the axle journals with respect to the side walls to permit free rotation of the circular transport member with respect to the body when the member is separated from the body and mounted for rotation with respect thereto, the circular transport member having a diameter such that when mounted for rotation with respect to the body the rim of the member extends beyond the lower boundary of the body to provide rolling support therefor.

These and other objects of the present invention will be more readily understood by reference to the following specification taken in conjunction with the accompanying drawings, in which:

DETAILED DESCRIPTION OF THE PREFERRED EMBODIMENT

Figure 1:
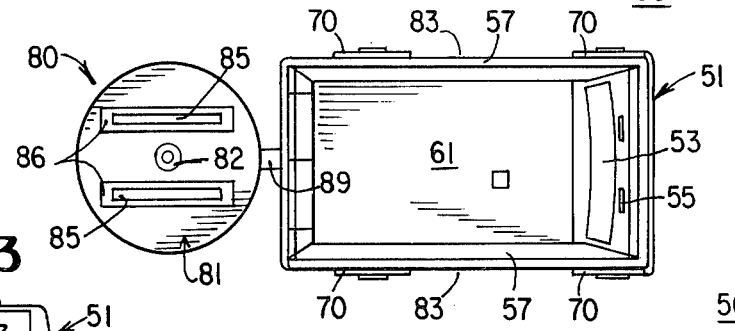
FIG. 1 is a top plan view of the one-piece molded construction.
Figure 3:
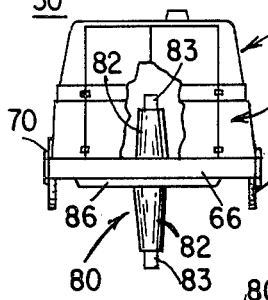
FIG. 3 is a rear elevational view of the one-piece molded construction illustrated in FIG. 1.
Figure 4:
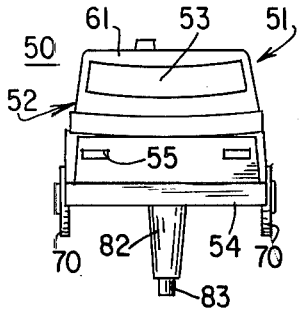
FIG. 4 is a front elevational view of the one-piece molded construction illustrated in FIG. 1.
Figure 2:
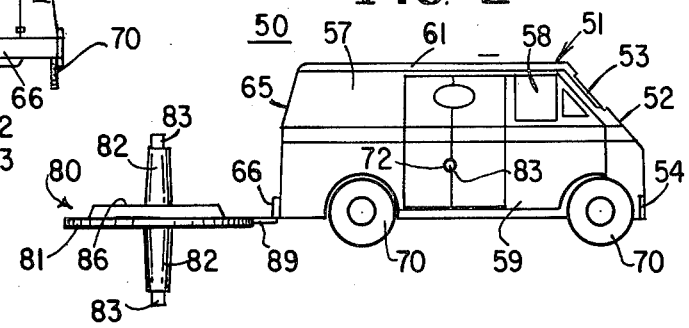
FIG. 2 is a side elevational view of the one-piece molded construction illustrated in FIG. 1.

Referring now to the drawings, and in particular to FIGS. 1 through 4 thereof, there is illustrated a one-piece construction 50 which includes a vehicle body 51 having a front 52 including a simulated window 53 and bumper 54. Spaced apart front lights 55 are provided in the usual spaced relation to the window 53 and bumper 54.

Spaced apart parallel side walls 57 interconnect with the front of the van 52 or vehicle 51, each of the side walls 57 being provided with a simulated window 58 and door 59. A top 60 is provided and interconnects the front 52 with the rear 65, the rear 65 being provided with a bumper 66 in the usual fashion. Four wheels 70 are provided, although these do not rotate. Spaced apart apertures 72 are positioned, one in each of the side walls 57 of the vehicle 51 with the apertures 72 being in registry on a horizontal axis.

A transport member 80 includes a disc 81 circular in shape having an axle 82 extending outwardly therefrom perpendicular to the plane of the disc 81. The axle 82 is provided at each end thereof with a journal 83, it being noted that the axle 82 tapers from the interconnection of the axle and the disc toward the distal end or journal 83. The disc 81 has a rim or periphery 84 which as will be described provides the rolling surface for the vehicle 51. Spaced apart slots 85 are positioned in the disc 81 on opposite sides of the axle 82, each of the slots 85 being provided with an upstanding rectangular frame member 86 to provide strength to the disc 81. A connecting strip 89 interconnects the transport member 80 with the vehicle 51, the connecting strip 89 being of relatively short length, narrow width and thickness to facilitate easy separation of the transport member 80 from the vehicle 51.

The longitudinal extent of the axle 82 including the journals 83 at each end thereof is sufficient to extend transversely of the vehicle 51 and to position each of the journals ends 83 into and through a respective one of the apertures 72. The diameter of each journal 83 is constructed and arranged to fit easily within the apertures 72 and freely to rotate with respect thereto.

Ballast 95 in the form of pennies or the like may be inserted into each of the slots 85 thereby to provide the transport member with sufficient weight to propel the vehicle 51 as hereinafter described.

Figure 5:
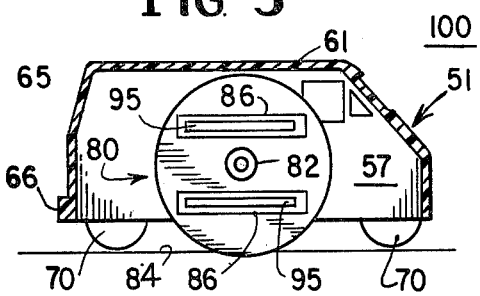
FIG. 5 is a sectional view of the one-piece construction assembled into a toy vehicle, particularly showing the spacial relationship between the vehicle body and the transport member.
Figure 6:
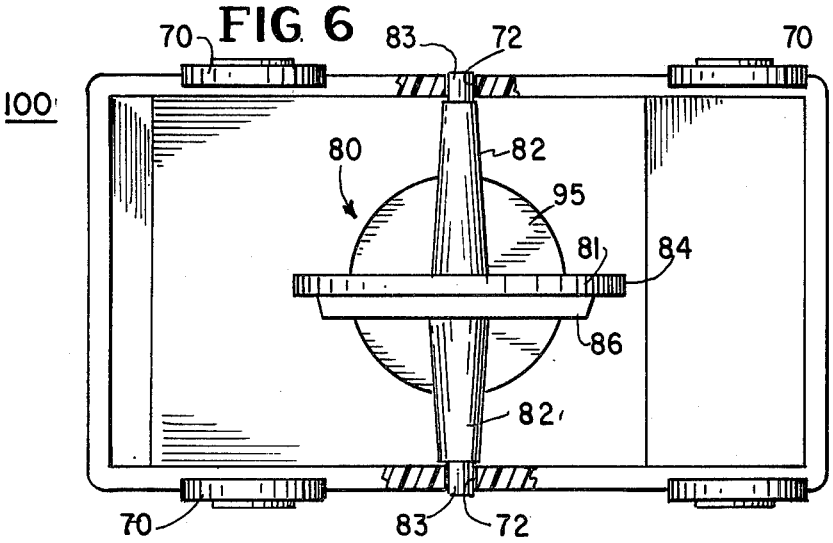
FIG. 6 is a bottom elevational view of the assembled vehicle illustrated in FIG. 5.

Referring now to FIGS. 5 and 6, there is disclosed the assembled vehicle 100 which includes the one-piece vehicle 51 previously described with the transport member 80 disconnected therefrom and in the assembled condition wherein the journals 83 extend into and through each of the apertures 72 thereby to mount the transport member 80 with respect to the vehicle 51 for free rotation with respect thereto. As shown in FIG. 5, the diameter of the disc 81 is such that when mounted as previously described, the rim 84 extends slightly beyond the distal end of the wheels 70 of the vehicle, thereby to provide a rolling surface for the vehicle. The ballast 95 in the form of pennies positioned in the slots 85 provide the necessary weight such that the vehicle 51 when pushed by a child will travel a great distance over a smooth surface such as linoleum or the like. Additionally, the ballast 95 enables the vehicle 100 to be given a rather strong push without fear of tipping or tilting thereby enabling the toy 100 to be used in a method simulating a real vehicle.

In a constructional example, the weight of the vehicle 51 was 7.7 grams, whereas the weight of the transport member 80 with the ballast 95 included was 7.9 grams, whereby it is seen that a weight ratio of about 1 between the vehicle body 51 and the transport member 80 with ballast 95, facilitates movement of the assembled vehicle 100 in a manner simulating a real vehicle.

Preferably, the slots 85 in the transport member 80 should be located as close to the rim 84 as possible to facilitate better momentum and movement of the assembled vehicle 100. Additionally, the inclusion of the ballast 95 in the transport member 80, is critical to the operation of the device, since loading the ballast 95 on the vehicle body itself results in a much less efficient operating toy. In fact, loading the ballast 95 on the vehicle body 51, results in a toy inferior in use than without any ballast at all.

Materials acceptable for the one-piece construction 50 include any synthetic organic resin having sufficient heat resistance and lubricity to permit the axle 82 with the journals 83 thereon to function efficiently in the apertures 72 without generating sufficient heat to damage the organic resin. Another requisite of the synthetic organic resin is that it be sufficiently flexible that children would not readily fracture same. Synthetic organic resins of the type useful in the present invention are high density polyethylene, polypropylene and polystyrene. Alternative materials to those above named, are readily known to those skilled in the art.

Another important feature of the present invention is the easy assembly of the vehicle 100. The connecting member or tab 89 can be severed with a house-holdscizzors and the rough ends smoothed with an ordinary nail file. The body 51 has sufficient flexibility that the sides 57 can be expanded sufficiently to permit the axle 82 of the transport member 80 to be inserted into the respective apertures 72. The memory of the plastic material used for the body 51, snaps the sides 57 back to their original position, thereby securely trapping the transport member 80, while allowing free rotation thereof. The one-piece construction 50 is also an important feature from a marketing and sales point of view, since handling is easier and packaging simpler.

Although the disclosure herein has been directed to a van-like vehicle, it will be understood that other shaped vehicles are well within the scope of the present invention, it being understood that the principal concept is the provision of a one-piece construction 50 which may be readily assembled into a two-piece assembled vehicle 100 with the requisite ballast 95 to provide a toy capable of being included in a cereal box as a premium item. The one-piece construction is crucial to the present invention as is the provision of the transport member 80 with the snap in axle 82 of the type described.

While there has been described what at present is considered to be the preferred embodiment of the present invention, it will be understood that various modifications and alterations may be made therein without departing from the true spirit and scope of the present invention and it is intended to cover in the appended claims all such modifications and alterations therein.

What is claimed is:

1. A toy vehicle comprising a body having opposing side walls, a circular transport member having an axle extending outwardly therefrom with journals at the distal ends thereof, means for supporting said axle journals with respect to said side walls to permit free rotation of said circular transport member with respect to said body, means for maintaining a ballast associated with said member evenly distributed around the axis of rotation of said member, the rim of said circular transport member extending beyond the lower boundary of said body to provide a rolling surface for said vehicle.

2. The toy vehicle set forth in claim 1, wherein said body and said transport member are synthetic organic resin selected from the class consisting of high density polyethylene, polypropylene and polystyrene.

3. The toy vehicle set forth in claim 1, wherein said support means are apertures in said side walls.

4. The toy vehicle set forth in claim 1, wherein said means supporting said axle journals are positioned about mid-way between the body, front and rear, thereby evenly to distribute the weight of said transport member with respect to the body.

5. The toy vehicle set forth in claim 1, wherein said journals are extensions of said axle having a reduced diameter with respect to the remainder of said axle.

6. The toy vehicle set forth in claim 1, wherein said the weight ratio of said vehicle to said transport member is about one.

7. A one-piece construction of synthetic organic resin comprising a body portion having opposing side walls, a circular transport member having an axle extending outwardly therefrom with journals on the distal ends thereof, means for maintaining a ballast associated with said member evenly distributed around the axis of rotation of said member, tab means interconnecting said body and said circular transport member having a reduced width, length, and thickness to facilitate separation of said transport member from said body, means for supporting said axle journals with respect to said side walls to permit free rotation of said circular transport member with respect to said body when said member is separated from said body and mounted for rotation with respect thereto, said circular transport member having a diameter such that when mounted for rotation with respect to said body the rim of said member extends beyond the lower boundary of said body to rolling support therefor.

8. The one-piece construction set forth in claim 7, wherein said ballast maintaining means are spaced apart slots in said transport member, one being positioned on each side of said axle with the longer dimension of said slots being parallel.

9. The one-piece construction set forth in claim 7, wherein the longer dimension of said axle is perpendicular to the longer dimension of said body and extends beyond the transverse extent thereof.

10. A toy vehicle comprising a body having opposing side walls, a circular transport member having an axle extending outwardly therefrom with the journals at the distal ends thereof, said circular transport member having an even number of apertures therein each to receive a ballast, means for supporting said axle journals with respect to said side walls to permit free rotation of said circular transport member with respect to said body, the rim of said circular transport member extending beyond the lower boundary of said body to provide a rolling surface for said vehicle.

11. The toy vehicle set forth in claim 10, wherein said transport member has two apertures therein, each being a rectangular slot positioned on the opposite sides of said axle positioned close to the periphery of said disc.

12. The toy vehicle set forth in claim 11, and further comprising a frame member defining the periphery of said apertures in said transport member reinforcing said member to accommodate the ballast when positioned therein.

* * * * *